United States Patent [19]

Kinnan

[11] Patent Number: 5,054,565

[45] Date of Patent: Oct. 8, 1991

[54] STEERING MECHANISM FOR A SUBSOIL BORING APPARATUS

[75] Inventor: Frank R. Kinnan, Camas Valley, Oreg.

[73] Assignee: Underground Technologies, Inc., Byron, Calif.

[21] Appl. No.: 528,872

[22] Filed: May 25, 1990

[51] Int. Cl.[5] ..... E21B 11/02

[52] U.S. Cl. ..... 175/19; 175/73; 175/135

[58] Field of Search ..... 175/19, 61, 73, 135, 175/170

[56] References Cited

U.S. PATENT DOCUMENTS 4,387,775 6/1983 Adolfsson et al. ..... 175/135

4,905,773 3/1990 Kinnan ..... 175/19

*Primary Examiner*—William P. Neuder

*Attorney, Agent, or Firm*—Lerner, David, Littenburg, Krumholz and Mentlik

[57] ABSTRACT

In an apparatus for creating an underground bore hole using high-pressure fluid within a steerable drill string to disturb and displace the subsoil, the improvement of the steering capability of the boring head by the inclusion of a percussive device to hammer the drill string forward after the desired steering of the boring head has take place to cause the boring head to fully engage the media being bored so that upon resumption of normal rotary drilling the boring head will proceed in the selected path.

5 Claims, 4 Drawing Sheets

STEERING MECHANISM FOR A SUBSOIL BORING APPARATUS

CROSS-REFERENCE TO RELATED APPLICATIONS

Method and Apparatus For Subsoil Drilling by Frank R. Kinnan, U.S. Pat. application Ser. No. 07/366,661 filed June 14, 1989 and assigned to the assignee of the instant application.

BACKGROUND OF THE INVENTION

1. Field of the Invention

The invention is directed to the field of subsurface boring with the use of high pressure fluid for the installation below ground of various utility items such as electrical cable, conduit, fluid-carrying pipes and ducts, gas lines, sewer pipes and the like.

2. Description of the Prior Art

The above-identified application discloses a drilling method and apparatus which departs from prior art techniques which are solely dependent upon fluid cutting for steering by utilizing fluid pressure to effect a positive action on the drill head to thereby direct the drilling head in the desired direction. By exceeding the predetermined fluid pressure determined by the dimensions of the fluid-conducting system, the drilling head is made to deflect from its normal position in the direction of desired movement of such drilling head. Such deflection of the drilling head is carried out while rotation of the drill string is terminated and once the deflection is completed, drilling is commenced in the new direction by the normal rotation and advancement of the drill string. Other prior art techniques for subsurface boring require that rotation of the drill string be stopped, the drilling head segments adjusted for a new direction of travel and rotation begin again. Such devices often use a beveled drill head, that is with one face of the drill head beveled in the direction of the longitudinal axis of the drill head or other wellknown drill head configurations.

The presence of hard materials such as rocks, hard soil, debris or conversely the presence of soft spots due to sand, wet soil, etc., may prevent the drilling head, whether according to the prior application of a prior-art beveled head or other well-known drilling heads, from getting a bite in the soil adjacent the end of the drilling head and cause it to drill in a direction offset from that desired based upon where the drill head gets a firm bite into the adjacent soil.

SUMMARY OF THE INVENTION

The present invention overcomes the difficulties noted above with respect to the device of the prior art.

The present invention improves the steering control of prior art devices by the application of a percussive force to the drill string to insure that the drill head is properly seated in the media being bored so that upon resumption of the drilling operation, the drill head moves in the desired direction. It is an object of the invention to provide an improved steering mechanism for a subsoil boring apparatus.

It is another object of the invention to provide an improved steering mechanism for a subsoil boring apparatus which includes a percussive device.

It is a principal object of the invention to provide an improved steering mechanism for a subsoil boring apparatus having a boring head which is rotatably driven to carry out such boring and which is steered by deflecting a portion of said boring head in response to fluid pressures in excess of a predetermined value, the improvement comprising a percussive device to advance said boring head in the desired direction after said boring head portion deflection and prior to the resumption of rotational boring.

It is still another object of the invention to improve the steering capability of available drilling heads.

The foregoing objects are carried out by mounting the drill string drive mechanism adjacent a percussive device which is operated to hammer the drill string forward during suspension of rotary drive of the drill string to insure proper engagement of the boring head with its surrounding media so that upon resumption of the rotary drilling operation, the boring head will advance in a selected direction.

Other objects and features of the invention will be pointed out in the following description and claims and illustrated in the accompanying drawings which disclose, by way of example, the principles of the invention and the best mode which has been presently contemplated for carrying them out.

BRIEF DESCRIPTION OF THE DRAWING

In the drawings in which similar elements are given similar reference characters.

DESCRIPTION OF THE PREFERRED EMBODIMENT

Figure 1:
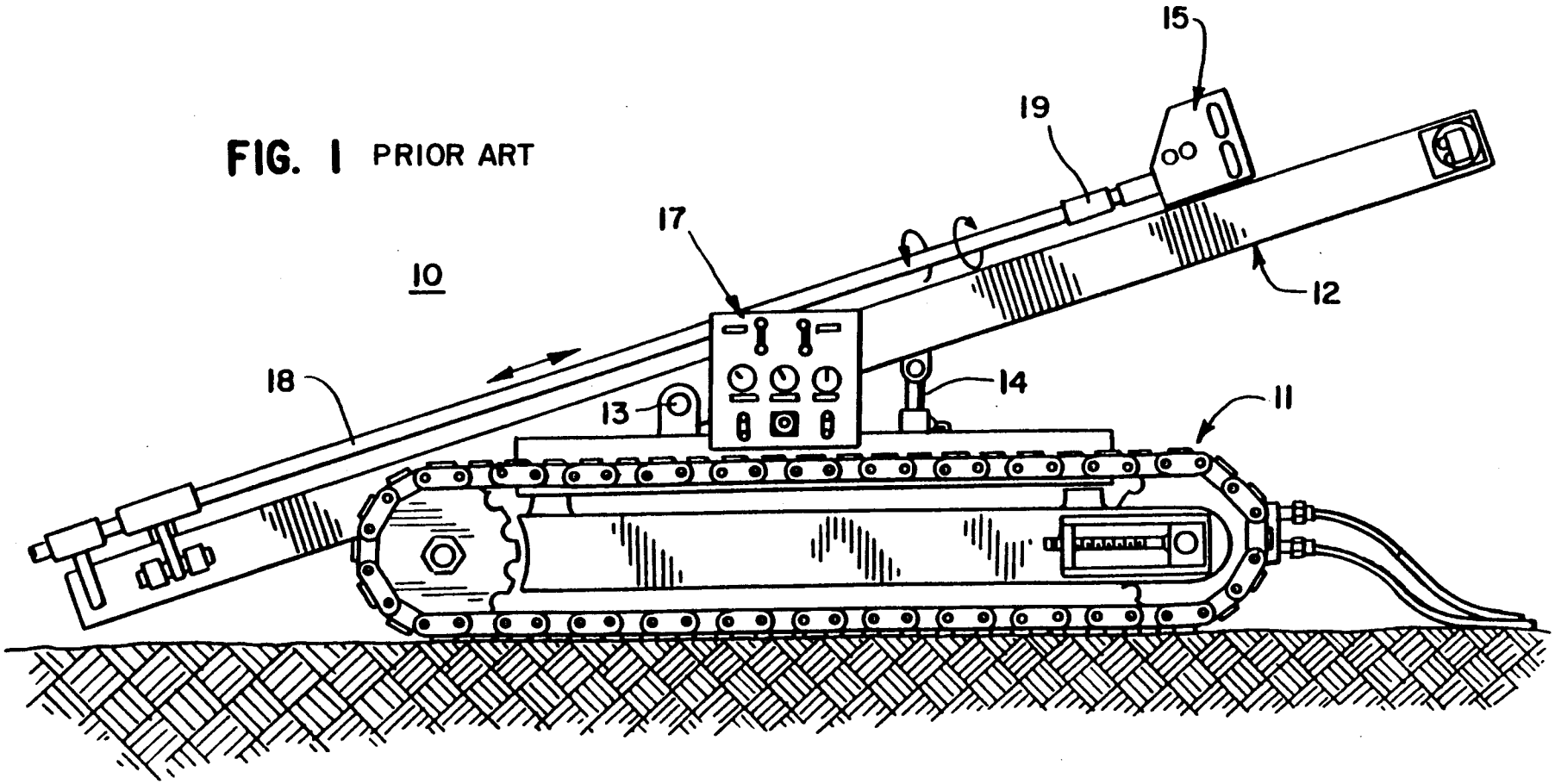
FIG. 1 PRIOR ART
FIG. 1 is a side elevational view of a drill pipe rotating and advancing apparatus and is FIG. 1 of U.S. Pat. application Ser. No. 07/366,661 filed June 14, 1989.
Figure 2:
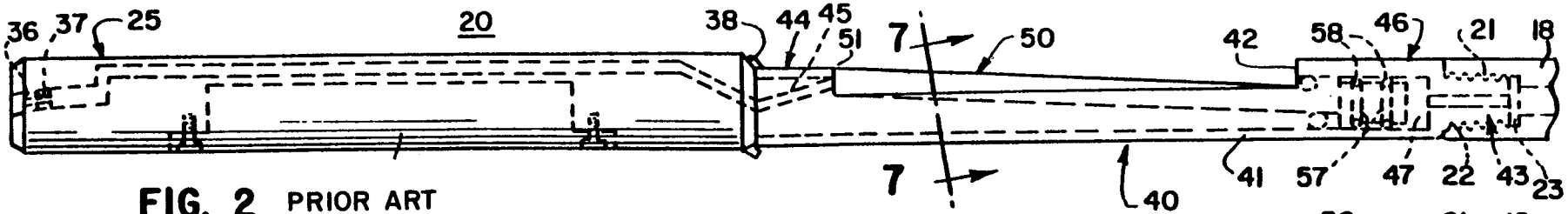
FIG. 2 PRIOR ART
FIG. 2 is a fragmentary side elevation of a boring head used with the apparatus of FIG. 1 and is FIG. 2 of the cited application.
Figure 3:
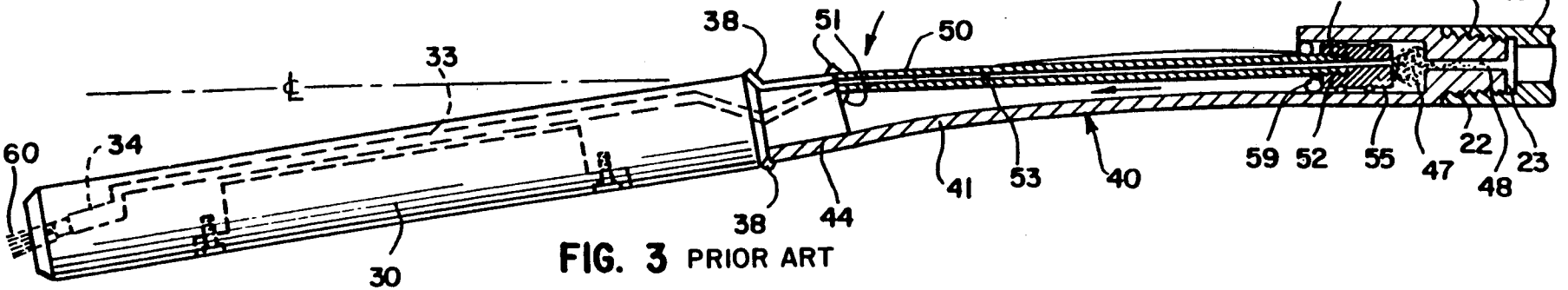
FIG. 3 PRIOR ART
FIG. 3 is the device of FIG. 2, partially in section, and illustrating the boring head in a displaced condition and is FIG. 3 of the cited application.

Turning now to FIGS. 1, 2 and 3, there is shown a subsoil drilling system according to the above-identified application from which these figures were taken, being FIG. 1, 2 and 3 of such application. Motor 15 drives pipe string 18 which in turn drives drilling and steering assembly 20 in the manner more fully described in the foregoing application. Rotation of the pipe string 18 is halted while the position of nose assembly 30 is adjusted by the steering mechanism 40. Upon the setting of the desired position of nose member 25, rotation of the pipe string 18 is recommenced and cutting fluid jets are emitted from nozzles 35(*a*) and 35(*b*) via carbide inserts 36, 37.

The presence of hard materials such as rocks, hard compacted soil, debris or conversely the presence of soft spots due to sand, wet soil, the accumulation of drilling fluid, etc., or any other condition that prevents the nose member 25 from taking a bite may prevent nose member 25 from moving in the desired direction upon the restart of rotation. The nose member 25 may wander or hunt until it is able to engage the media and advance and the resulting direction of movement may be other than that desired.

To insure that the nose member 25 is better able to advance in the desired direction, it has been found advantageous to apply one or more impact strokes to the pipe string 18 prior to the time rotation is recommenced. The impact strokes tend to hammer the nose member 25 into the soil properly aligned with the desired direction of movement. It also tends to break up the soil, rocks, debris or other impediments to the proper advance of nose member 25.

Figure 6:
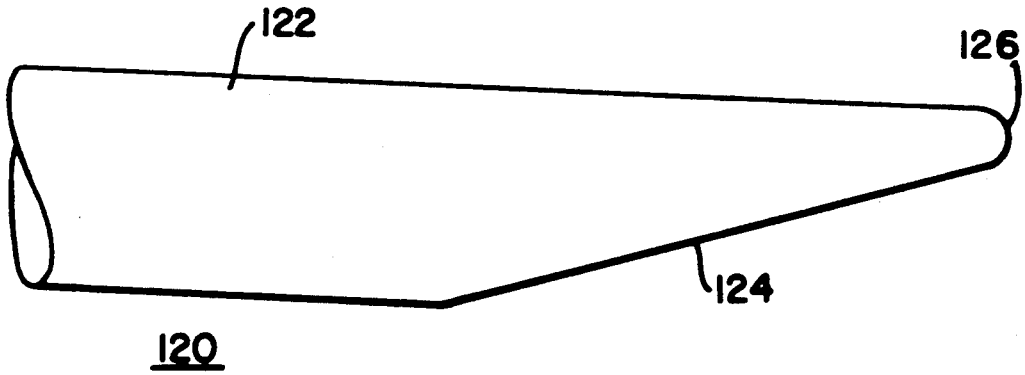
FIG. 6 is a fragmentary side elevation of a beveled-face drill head.

The invention is equally applicable to well-known bevel-faced drill heads 120 as shown in FIG. 6. Bevel-faced drill head 120 is generally cylindrical as at 122 with one beveled face 124 ending in a rounded small diameter tip 126. The smaller overall diameter permits a smaller initial bore to be created which is enlarged as beveled face 124 is advanced. The small tip 126, however, is more easily deflected by the presence of rocks, hard compacted soil, debris or the like. The impact strokes applied to the pipe string 18 permits tip 126 to break up such rocks, hard compacted soil and debris and permits the beveled face 126 to compact the soil about it and engage the media so that drill head 120 moves in the correct direction.

Figure 4:
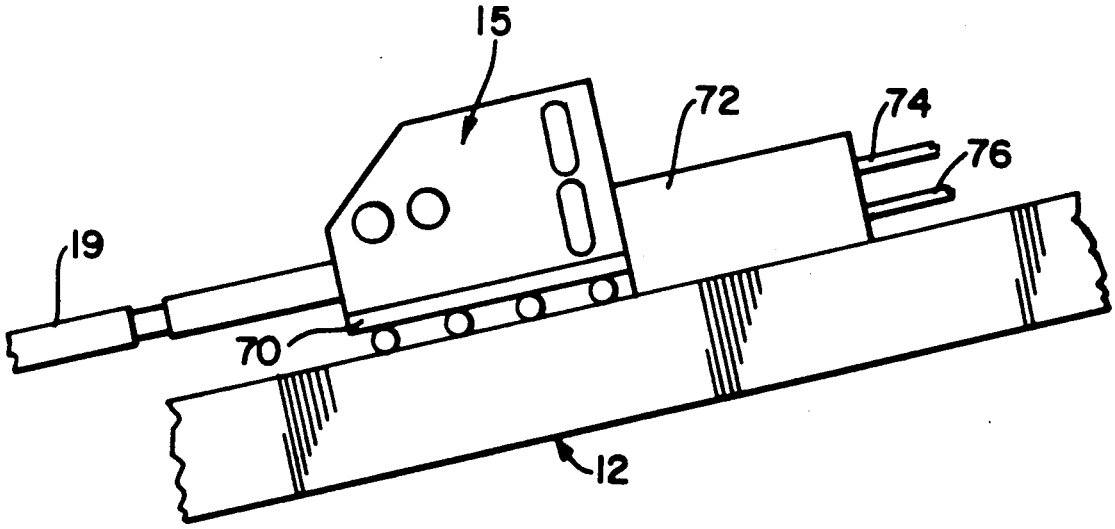
FIG. 4 is a fragmentary side elevation of the apparatus of FIG. 1 incorporating the invention as disclosed herein.

As is shown in FIG. 4, motor 15 is mounted upon a rolling carriage 70 capable of moving along boom 12. An impact device 72 is mounted to boom 12 adjacent motor 15 with its anvil (to be described below) in contact with the last pipe of the pipe string 18. Impact device 72 has an inlet line 74 and an outlet or return line 76 both coupled to a pulsed source of high-pressure fluid (not shown). By controlling the pulsed source, one or more hammering cycles can be applied to pipe string 18 depending upon the characteristics of the soil ahead of nose member 25.

Figure 5:
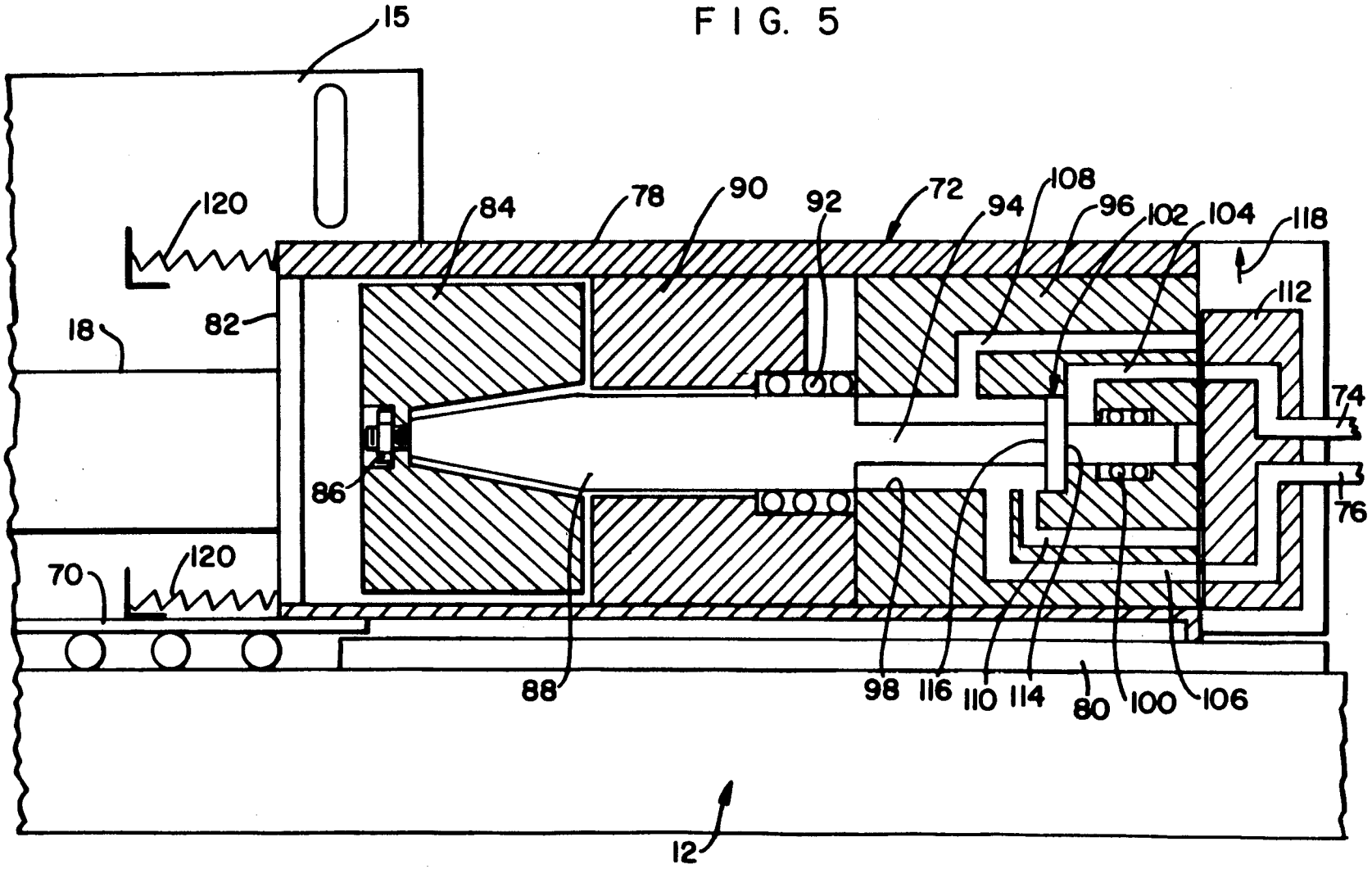
FIG. 5 is a fragmentary side elevation, partially in section, of the device of FIG. 4 illustrating the impacting unit.

Impact device 72 shown in FIG. 5 has an outer casing 78 mounted upon a rail 80 which is welded, bonded, bolted or otherwise attached to boom 12. At the leading edge of casing 78 is an anvil 82 which is in direct contact with the end of the last pipe of the pipe string 18 and imparts all forces applied to it directly to such pipe. Anvil 82 may be a ⅜ inch steel plate. Mounted within casing 78 is a weight 84 which is moved to strike anvil 82 on alternate strokes. Weight 84 is approximately 8 to 9 pounds in weight.

Weight 84 is bolted, as at 86, to the end of tapered shaft 88 which moves within a bearing block 90. Seals 92 prevent fluid from the piston chamber entering the bearing block 90. Shaft 88 is provided with a reduced diameter portion 94 which moves within the piston chamber 98 of valve block 96. Seals 100 prevent the leakage of fluid from the piston chamber 98 along shaft portion 94.

A piston 102 is attached to shaft portion 94 for movement within piston chamber 98. Movement of piston 102 is controlled by the ports 104, 106, 108 and 110 depending upon the position of sliding valve 112. In the position shown in FIG. 5, the piston is in its rightmost position with weight 84 at its maximum separation from anvil 82. With sliding valve 112 in the position shown, the application of a high-pressure pulse of fluid via inlet line 74 will be applied to port 104 and to the back surface 114 of piston 102 causing piston 102 to move to the left in FIG. 5 until weight 84 strikes anvil 82. At this position, piston 102 uncovers port 106 and the fluid, having lost most of its pressure head, will be permitted to drain via port 106 to the return line 76. Sliding valve 112 is now moved upwardly in the direction of arrow 118 to reposition lines 74 and 76 with respect to ports 108, 110. A pulse of high-pressure fluid from line 74 passes port 108 to impact upon front face 116 of piston 102 and drive it toward the right in FIG. 5 until port 110 is uncovered and the fluid drained via return line 76. Piston 102 is now at its initial position as shown in FIG. 5 ready for another impact/restore cycle as described. As many cycles as required may be carried out by controlling the fluid source. Tension springs 120 which are stretched as the carriage 70 is forced forward, restore the pipe end against the anvil 82 after each cycle. Interlocks may be provided to prevent the motor 15 from rotating when the impact device 72 is operated and conversely to prevent the operation of the impact device 72 when motor 15 is operating to prevent possible damage to either device. The interlock can be of the type known to the art which only applies high-pressure fluid to motor 15 or impact device 72 but not to both.

While there have been shown and described and pointed out the fundamental novel features of the invention as applied to the preferred embodiment, it will be understood that various omissions and substitutions and changes of the form and details of the devices illustrated and in its operation may be made by those skilled in the art without departing from the spirit of the invention.

The embodiments of the invention in which an exclusive property or privilege is claimed are defined as follows:

1. A subsoil boring apparatus comprising:

a rotatable, steerable boring assembly;

motor means for producing rotary motion;

pipe string means coupled to said motor means and said boring assembly to import rotation thereto; and impacting means coupled to said motor means to apply impact forces to said pipe string means to improve the steerability of said boring assembly wherein only one of said motor means and said impact means can be applied to said pipe string means at one time.

2. A subsoil boring apparatus as defined in claim 1, wherein one or more impact strokes can be applied to said pipe string means between cycles of rotation of said pipe string means.

3. A subsoil boring apparatus as defined in claim 1, wherein said motor means is mounted upon a movable carriage adjacent to and coupled to a rigidly mounted impact means so that said motor means moves with each impact stroke of said impact means.

4. A subsoil boring apparatus as defined in claim 1, wherein the applied impact forces cause said boring assembly to bite into the subsoil ahead of said boring assembly to insure such assembly follows a selected path.

5. A subsoil boring apparatus as defined in claim 1, wherein said impact means comprises an anvil engaging the end of the last pipe in said pipe string and a selectively movable weight to apply impacts to said anvil.

* * * * *

UNITED STATES PATENT AND TRADEMARK OFFICE

CERTIFICATE OF CORRECTION

PATENT NO. : 5,054,565

DATED : October 8, 1991

INVENTOR(S) : Frank R. Kinnan

It is certified that error appears in the above-identified patent and that said Letters Patent is hereby corrected as shown below:

Column 1, Line 40, "wellknown" shouldread --well-known--.
Column 4, Line 39, "import" should read --impart--.
Column 4, Line 41, "impacting" should read --impact--.

Signed and Sealed this

Twenty-seventh Day of April, 1993

*Attest:*

MICHAEL K. KIRK

*Attesting Officer*

*Acting Commissioner of Patents and Trademarks*